US008186193B2

(12) United States Patent
Huang et al.

(10) Patent No.: US 8,186,193 B2
(45) Date of Patent: May 29, 2012

(54) LOCK CYLINDER STRUCTURE

(75) Inventors: Chao-Ming Huang, Kaohsiung County (TW); Chi-Ming Chen, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 303 days.

(21) Appl. No.: 12/651,242

(22) Filed: Dec. 31, 2009

(65) Prior Publication Data

US 2011/0154871 A1 Jun. 30, 2011

(51) Int. Cl.
*E05B 9/04* (2006.01)

(52) U.S. Cl. ..... 70/375; 70/493; 70/367; 70/421

(58) Field of Classification Search ..... 70/419–421, 70/373, 375, 378, 493
See application file for complete search history.

(56) References Cited

U.S. PATENT DOCUMENTS

| | | | | |
|---|---|---|---|---|
| 1,755,847 | A * | 4/1930 | Stevens | 70/493 |
| 1,915,897 | A * | 6/1933 | Maxwell et al. | 70/407 |
| 3,045,468 | A * | 7/1962 | Welch et al. | 70/421 |
| 3,175,379 | A * | 3/1965 | Russell et al. | 70/383 |
| 3,195,330 | A * | 7/1965 | Bauer | 70/421 |
| 3,324,693 | A * | 6/1967 | Check | 70/369 |
| 3,395,558 | A * | 8/1968 | Russell et al. | 70/493 |
| 3,986,376 | A * | 10/1976 | Lack | 70/493 |
| 4,185,480 | A * | 1/1980 | Pechner | 70/358 |
| 4,282,731 | A * | 8/1981 | Taksony | 70/493 |
| 7,421,870 | B1 * | 9/2008 | Wu et al. | 70/358 |
| 2007/0271976 | A1 * | 11/2007 | Dalton et al. | 70/493 |
| 2008/0016928 | A1 * | 1/2008 | Yang et al. | 70/367 |
| 2008/0276674 | A1 * | 11/2008 | Huang et al. | 70/493 |
| 2009/0173121 | A1 * | 7/2009 | Cheng et al. | 70/493 |
| 2011/0271724 | A1 * | 11/2011 | Huang et al. | 70/493 |

* cited by examiner

*Primary Examiner* — Suzanne Barrett
(74) *Attorney, Agent, or Firm* — Muncy, Geissler, Olds & Lowe, PLLC

(57) ABSTRACT

A lock cylinder structure comprises a cylinder body, a plug disposed within the cylinder body, a pin assembly and a key positioning assembly. The cylinder body has a plurality of upper pin holes and an accommodating hole. The plug has an outside wall, a keyhole, a plurality of lower pin holes and a through hole in communication with the outside wall and the keyhole. The pin assembly comprises a plurality of upper pins disposed within the upper pin holes and a plurality of lower pins disposed within the lower pin holes. The key positioning assembly comprises a first movable member disposed at the accommodating hole of the cylinder body and a second movable member disposed at the through hole of the plug. The second movable member contacts against the first movable member and has a push-receiving surface.

14 Claims, 5 Drawing Sheets

LOCK CYLINDER STRUCTURE

FIELD OF THE INVENTION

The present invention is relating to a lock cylinder structure, more particularly to a lock cylinder structure.

BACKGROUND OF THE INVENTION

In general, cylinder body and plug of known lock cylinder structure setup pins including a plurality of upper pins of same height disposed within the cylinder body and a plurality of lower pins of different height disposed within the plug. Combination of the upper and lower pins is utilized to limit the plug not to rotate within the cylinder body so as to perform functions of limitation and rotation-proof. It needs to insert a proper key into the plug as opening lock, in which the proper key has a bitting with different height for engaging with the lower pins with different height. When the proper key is inserted into the plug, top surfaces of every lower pins of the plug are roughly aligned with the interface between the cylinder body and the plug allowing the plug not to be limited by the upper and lower pins capable of rotating within the cylinder body. However, when a burglar attempts to illegally open a lock, he may insert a tool into keyhole of the plug to force pins bouncing upward and rotate the plug timely thereby easily opening lock, so burglarproof and security are inefficient needed to be improved.

SUMMARY

A main object of the present invention is to provide a lock cylinder structure comprising a cylinder body, a plug disposed within the cylinder body, a pin assembly and a key positioning assembly. The cylinder body has a plurality of upper pin holes and an accommodating hole. The plug has an outside wall, a keyhole, a plurality of lower pin holes and a through hole in communication with the outside wall and the keyhole. The pin assembly comprises a plurality of upper pins disposed within the upper pin holes and a plurality of lower pins disposed within the lower pin holes. The key positioning assembly comprises a first movable member disposed at the accommodating hole of the cylinder body and a second movable member disposed at the through hole of the plug. The second movable member contacts against the first movable member and has a push-receiving surface. In accordance with the present invention, a push-applying surface of the proper key must push the push-receiving surface of the second movable member when opening lock to allow the second movable member moving to rotating interface and releasing limitation of the plug limited by the first movable member. Therefore, it is very difficult to move the second movable member to rotating interface when burglar inserts a lock-picking tool into the keyhole of the plug, so the present invention is capable of widely improving burglarproof and security of lock cylinder.

DETAILED DESCRIPTION OF THE INVENTION

Figure 1:
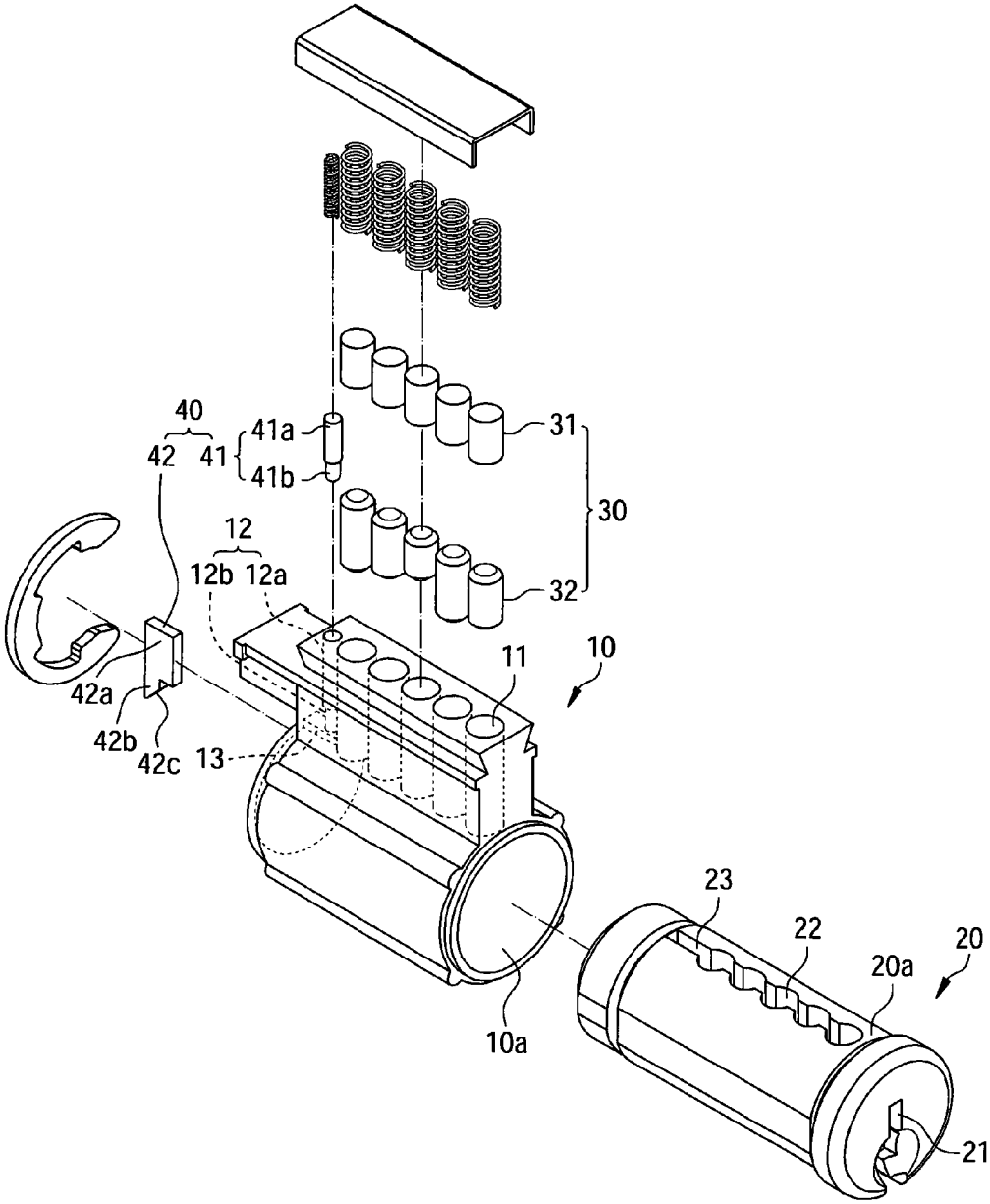
FIG. 1 is a perspective exploded view illustrating a lock cylinder structure in accordance with a preferred embodiment of the present invention.
Figure 2:
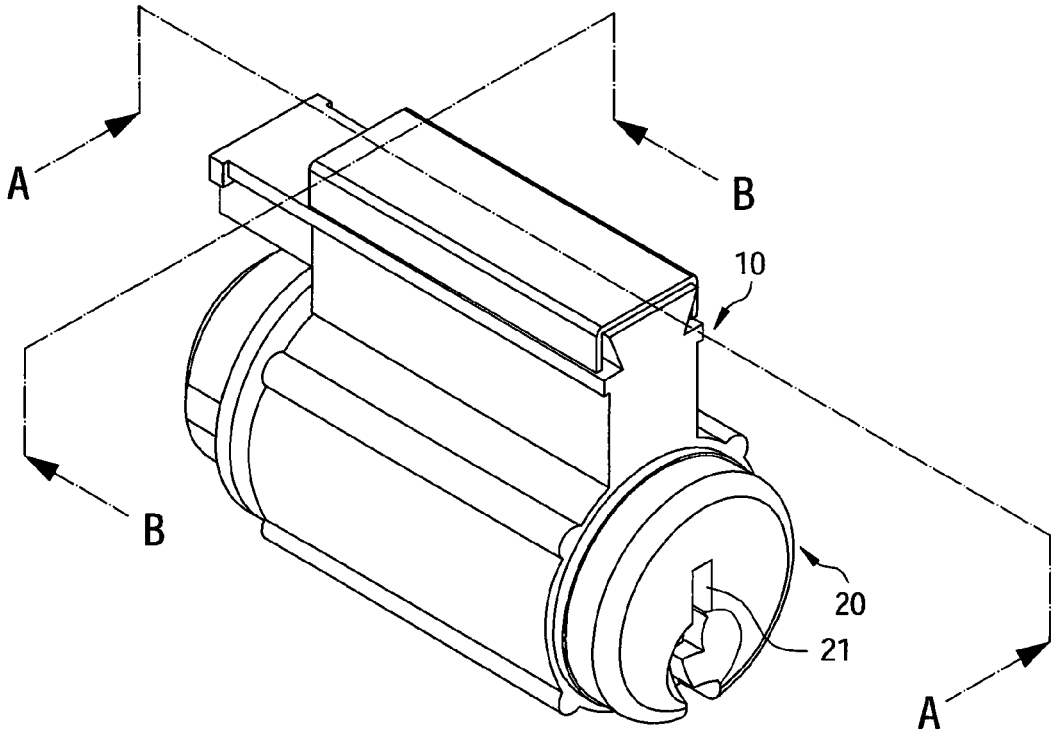
FIG. 2 is a perspective assembly view illustrating the lock cylinder structure.
Figure 3:
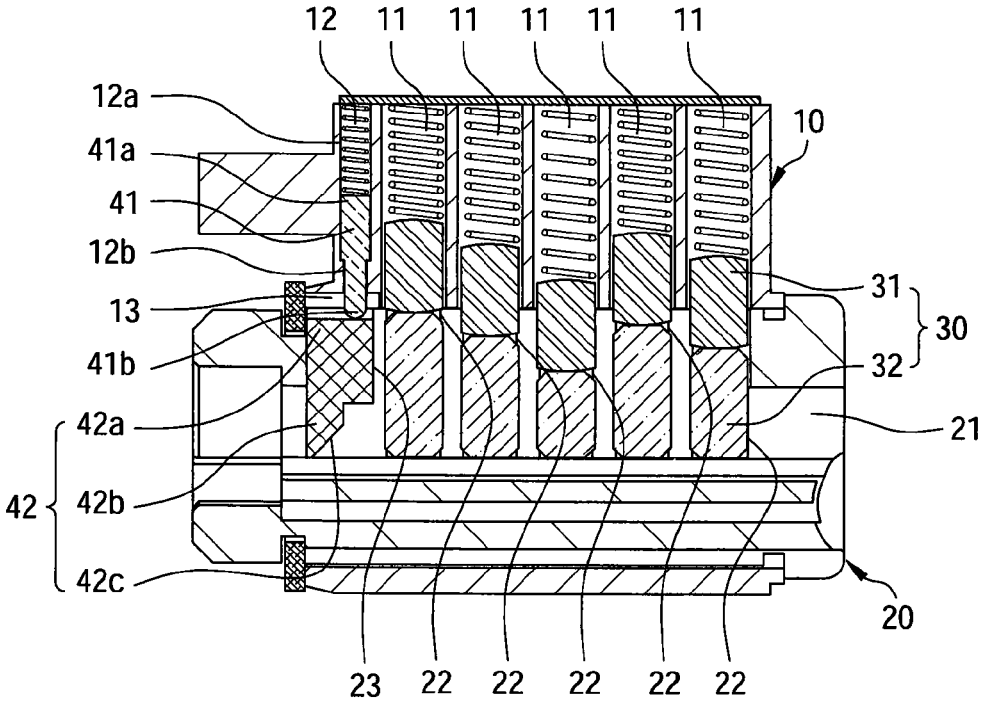
FIG. 3 is a transverse section view illustrating the lock cylinder structure along A-A line of FIG. 2.
Figure 4:
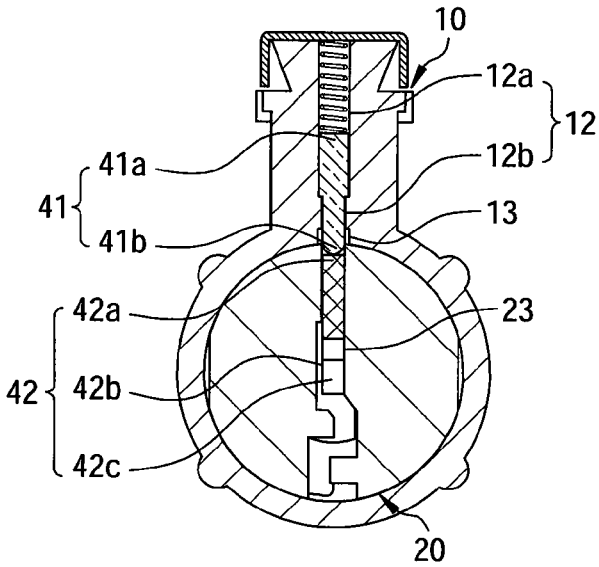
FIG. 4 is a longitudinal section view illustrating the lock cylinder structure along B-B line of FIG. 2.

With reference to FIGS. 1, 2 and 3, a lock cylinder structure in accordance with a preferred embodiment of the present invention comprises a cylinder body 10, a plug 20 disposed within the cylinder body 10, a pin assembly 30 and a key positioning assembly 40. The cylinder body 10 has an inside wall 10*a*, a plurality of upper pin holes 11, an accommodating hole 12 and a limiting slot 13 recessed from the inside wall 10*a*. The accommodating hole 12 has an upper slot portion 12*a* and a lower slot portion 12*b*, in which an inner diameter of the upper slot portion 12*a* is smaller than that of each upper pin hole 11 but larger than that of the lower slot portion 12*b*. Besides, the limiting slot 13 communicates with the lower slot portion 12*b* of the accommodating hole 12. With reference to FIGS. 1, 3 and 4, the plug 20 has an outside wall 20*a*, a keyhole 21, a plurality of lower pin holes 22 and a through hole 23 in communication with the outside wall 20*a* and the keyhole 21, in which the through hole 23 corresponds to the limiting slot 13 of the cylinder body 10 within this embodiment. The pin assembly 30 comprises a plurality of upper pins 31 disposed within the upper pin holes 11 of the cylinder body 10 and a plurality of lower pins 32 disposed within the lower pin holes 22 of the plug 20.

Figure 5:
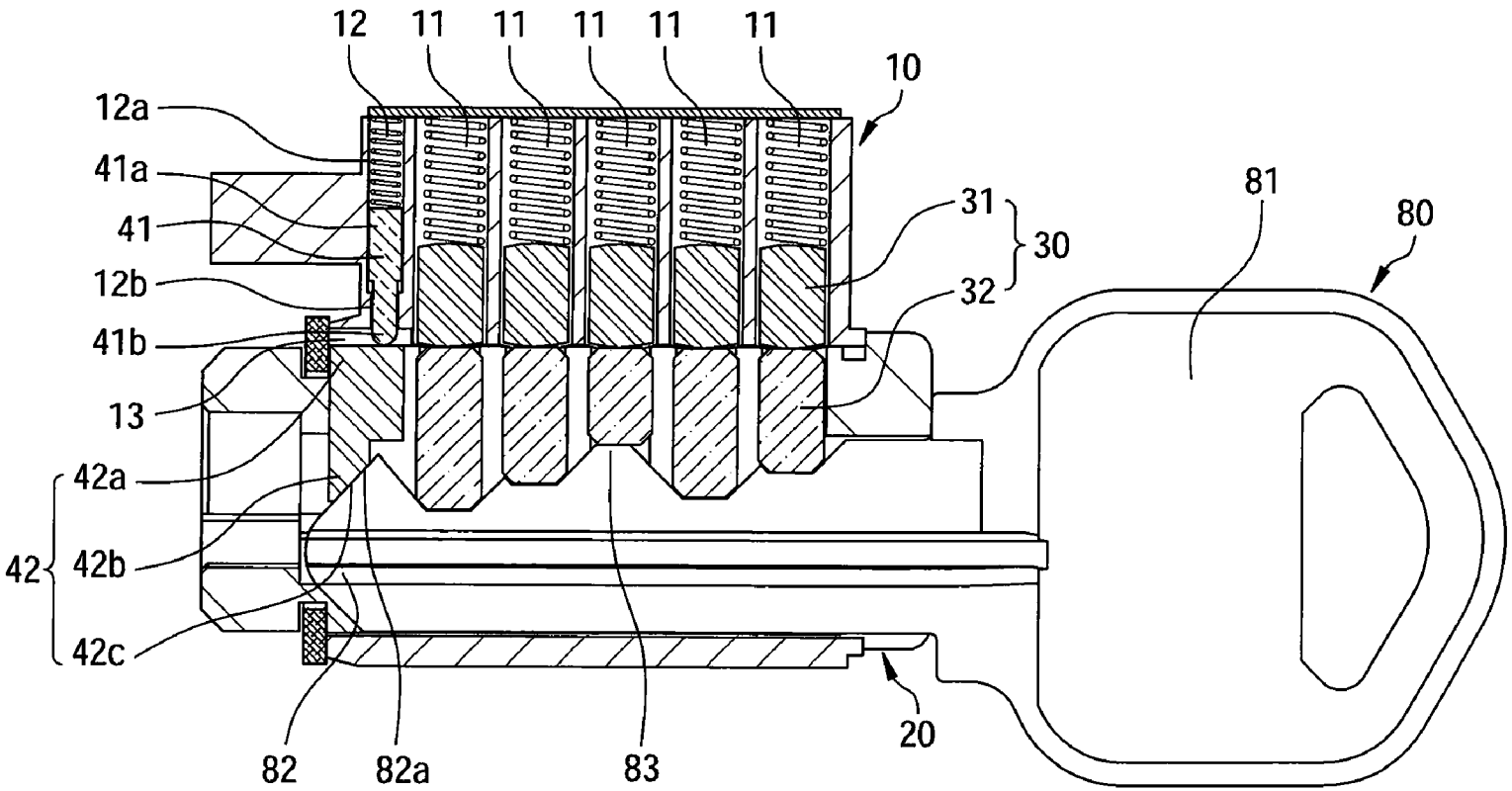
FIG. 5 is a view illustrating a matched key is inserted in accordance with a preferred embodiment of the present invention.
Figure 6:
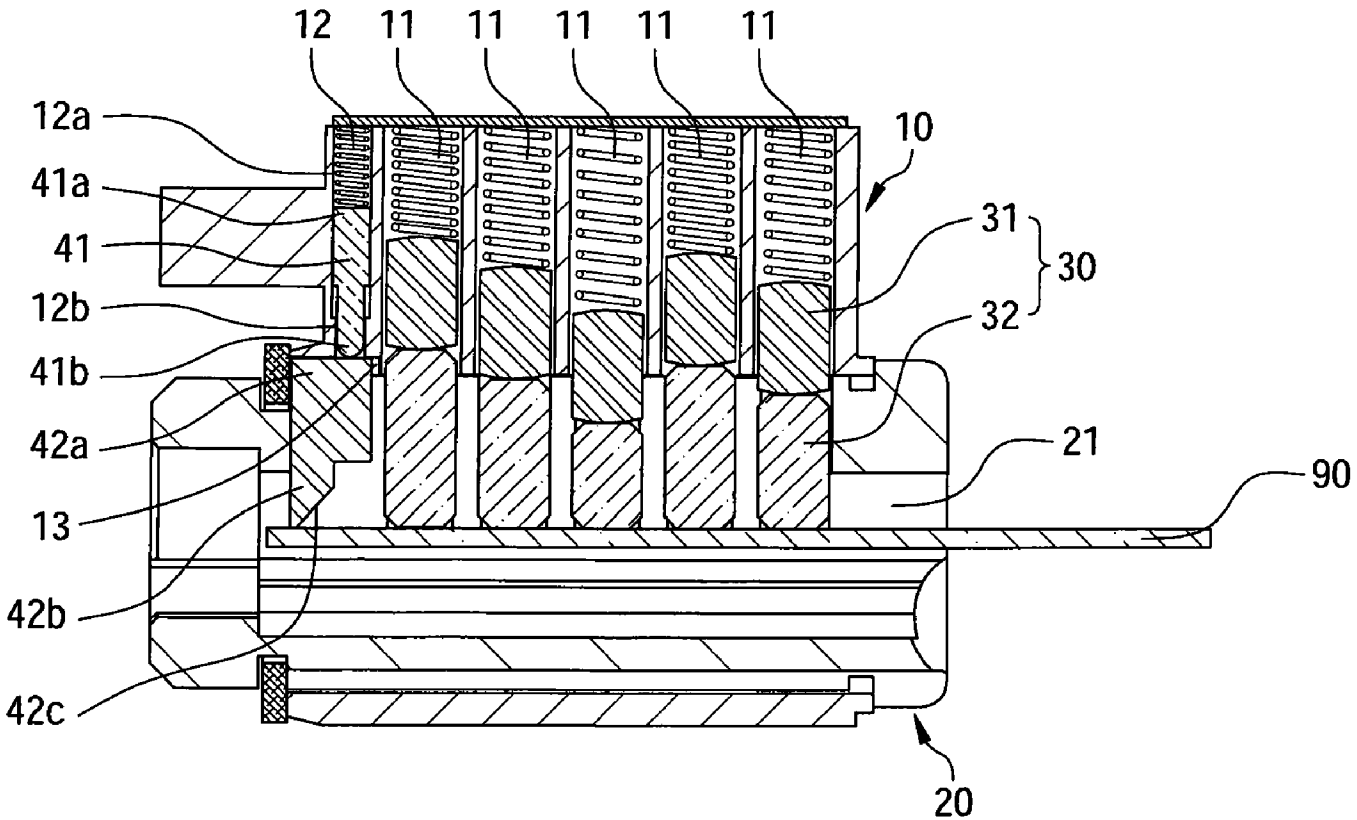
FIG. 6 is a view illustrating a lock-picking tool is inserted in accordance with a preferred embodiment of the present invention.

With reference again to FIGS. 1, 3 and 4, the key positioning assembly 40 comprises a first movable member 41 and a second movable member 42. The first movable member 41 disposed at the accommodating hole 12 of the cylinder body 10 has an upper rod portion 41*a* located at the upper slot portion 12*a* of the accommodating hole 12, a lower rod portion 41*b* disposed by penetrating the lower slot portion 12*b* of the accommodating hole 12 and the limiting slot 13 and an end 41*c* facing the through hole 23, in which a diameter of the upper rod portion 41*a* is larger than that of the lower rod portion 41*b*. The second movable member 42 is disposed at the through hole 23 of the plug 20 and contacts against the first movable member 41. Within this embodiment, the second movable member 42 has a first side 42*a* contacting against the end 41*c* of the first movable member 41, a second side 42*b* opposite to the first side 42*a* and a push-receiving surface 42*c* formed at the second side 42*b*, preferably the push-receiving surface 42*c* is an inclined surface. Operation of the key positioning assembly 40 in accordance with the present invention will be described in detail as follow by referring to FIGS. 5 and 6. Initially, with reference to FIG. 5, a matched key 80 is inserted into the keyhole 21 of the plug 20, in which the matched key 80 has a grip portion 81, an ending portion 82 and a rack portion 83 located between the grip portion 81 and the ending portion 82, the ending portion 82 has a push-applying surface 82*a*, preferably the push-applying surface 82*a* is an inclined surface. When the matched key 80 is inserted into the keyhole 21 of the plug 20, the push-applying surface 82*a* of the matched key 80 will first contact against the push-receiving surface 42*c* of the second movable member 42. When the matched key 80 is inserted into at the position, the push-applying surface 82*a* of the matched key 80 pushes the second movable member 42 to rotating interface and meantime the first movable member 41 releases limitation of plug 20 that the plug 20 can be rotated to open lock. Contrarily, with reference to FIG. 6, when a lock-picking tool 90 is inserted into the keyhole 21 of the plug 20, the lock-picking tool 90 is unable to push the second movable member 42 to rotating interface, so the plug 20 is unable to be rotated due to be limited by the first movable member 41. Besides, when burglar attempts to pick the second movable member 42 with a lock-picking tool 90 for moving the second movable member 42 to rotating interface, the limiting slot 13 of the cylinder body 10 of the present invention may provide an accommodating space to allow the second movable member 42 moving to the limiting slot 13 without halting at rotating interface. Accordingly, the first movable member 41 can certainly limit the plug 20 so the present invention is capable of widely improving burglar-proof and security of lock cylinder.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A lock cylinder structure comprising:

a cylinder body having a plurality of upper pin holes and a accommodating hole;

a plug disposed within the cylinder body and having an outside wall, a keyhole, a plurality of lower pin holes and a through hole in communication with the outside wall and the keyhole;

a plurality of upper pins disposed within the upper pin holes;

a plurality of lower pins disposed within the lower pin holes;

a first movable member disposed at the accommodating hole of the cylinder body and having an end facing the through hole;

a second movable member disposed at the through hole of the plug and having a first side contacting against the end of the first movable member, a second side opposite to the first side and a push-receiving surface formed at the second side; and wherein the accommodating hole has an upper slot portion and a lower slot portion, an inner diameter of the lower slot portion is smaller than that of the upper slot portion.

2. The lock cylinder structure in accordance with claim 1, wherein the first movable member has an upper rod portion and a lower rod portion, the upper rod portion is located at the upper slot portion of the accommodating hole, a diameter of the upper rod portion is larger than that of the lower rod portion.

3. The lock cylinder structure in accordance with claim 2, wherein the cylinder body has an inside wall and a limiting slot recessed from the inside wall, the limiting slot communicates with the lower slot portion of the accommodating hole.

4. The lock cylinder structure in accordance with claim 3, wherein the lower rod portion of the first movable member is disposed by penetrating the lower slot portion of the accommodating hole and the limiting slot.

5. The lock cylinder structure in accordance with claim 1, wherein an inner diameter of the upper slot portion of the accommodating hole is smaller than that of each upper pin hole.

6. The lock cylinder structure in accordance with claim 1, wherein the push-receiving surface of the second movable member is an inclined surface.

7. The lock cylinder structure in accordance with claim 1, wherein the second movable member is a plate-shaped member.

8. A lock cylinder structure comprising:

a cylinder body having a plurality of upper pin holes and a accommodating hole;

a plug disposed within the cylinder body and having an outside wall, a keyhole, a plurality of lower pin holes and a through hole in communication with the outside wall and the keyhole;

a plurality of upper pins disposed within the upper pin holes;

a plurality of lower pins disposed within the lower pin holes;

a first movable member disposed at the accommodating hole of the cylinder body and having an end facing the through hole;

a second movable member disposed at the through hole of the plug and having a first side contacting against the end of the first movable member, a second side opposite to the first side and a push-receiving surface formed at the second side;

a matched key inserted into the keyhole of the plug and having a grip portion, an ending portion and a rack portion located between the grip portion and the ending portion, wherein the ending portion has a push-applying surface to contact against the push-receiving surface of the second movable member; and wherein the accommodating hole has an upper slot portion and a lower slot portion, an inner diameter of the lower slot portion is smaller than that of the upper slot portion.

9. The lock cylinder structure in accordance with claim 8, wherein the first movable member has an upper rod portion and a lower rod portion, the upper rod portion is located at the upper slot portion of the accommodating hole, a diameter of the upper rod portion is larger than that of the lower rod portion.

10. The lock cylinder structure in accordance with claim 9, wherein the cylinder body has an inside wall and a limiting slot recessed from the inside wall, the limiting slot communicates with the lower slot portion of the accommodating hole.

11. The lock cylinder structure in accordance with claim 10, wherein the lower rod portion of the first movable member is disposed by penetrating the lower slot portion of the accommodating hole and the limiting slot.

12. The lock cylinder structure in accordance with claim 8, wherein an inner diameter of the upper slot portion of the accommodating hole is smaller than that of each upper pin hole.

13. The lock cylinder structure in accordance with claim 8, wherein the push-applying surface of the ending portion of the matched key is an inclined surface.

14. The lock cylinder structure in accordance with claim 8, wherein the second movable member is a plate-shaped member.

* * * * *